United States Patent [19]

Sato

[11] 4,411,197

[45] Oct. 25, 1983

[54] PRINTING DEVICE FOR HAND LABELER

[75] Inventor: Yo Sato, Tokyo, Japan

[73] Assignee: Kabushiki Kaisha Sato Kenkyusho, Japan

[21] Appl. No.: 381,547

[22] Filed: May 24, 1982

[30] Foreign Application Priority Data

Aug. 14, 1979 [JP] Japan ..... 54-111220

[51] Int. Cl.[3] ..... B41K 1/10; B41J 11/20

[52] U.S. Cl. ..... 101/291; 101/288; 101/407 BP; 400/661.3

[58] Field of Search ..... 101/288–292, 101/407 BP, 407 R; 400/661.3

[56] References Cited

U.S. PATENT DOCUMENTS

| | | | |
|---|---|---|---|
| 998,510 | 7/1911 | Heron | 400/661.3 |
| 1,116,395 | 11/1914 | Dowd | 400/661.3 |
| 2,035,310 | 3/1936 | Florance | 101/407 BP |
| 2,418,698 | 4/1947 | Conard | 400/661.3 |
| 3,024,725 | 3/1962 | Hempel | 101/407 R |
| 3,245,345 | 4/1966 | Graham | 101/407 R |
| 3,295,438 | 1/1967 | Webb et al. | 101/407 BP |
| 3,480,127 | 11/1969 | Hesse et al. | 400/661.3 |
| 3,868,008 | 2/1975 | Brumbaugh | 400/661.3 |
| 3,920,113 | 11/1975 | Tamal | 400/661.3 |
| 4,176,603 | 12/1979 | Sato | 101/288 |
| 4,215,946 | 8/1980 | Nakabo et al. | 400/661.3 |

*Primary Examiner*—William Pieprz

*Attorney, Agent, or Firm*—Ostrolenk, Faber, Gerb & Soffen

[57] ABSTRACT

The disclosure concerns a printing device for use with a hand labeler, or the like. The printing device includes a platen and a printing head which carries a plurality of types on its printing surface, and which is moved into and out of contact with the platen thereby to print a label with a row of type characters. A type receiving plate is a part of the platen and it is made of an elastic material. The type receiving plate has dividing grooves which are parallel to one another and define type receiving lands. The type receiving lands are positioned to register with respective type characters when the printing head operates. The lands can be elastically deformed independently of one another. Thus, the type receiving lands can cooperate with the respective types to provide uniform printing pressure during the printing operation.

8 Claims, 6 Drawing Figures

PRINTING DEVICE FOR HAND LABELER

This is a continuation of application Ser. No. 177,378 filed Aug. 12, 1980, now abandoned.

BACKGROUND OF THE INVENTION

1. Field of the Invention

The present invention relates to a labeling machine of the portable type, and more particularly to a printing device for use with the labeling machine, wherein the printing device provides an averaged clear print upon a printing medium such as a label.

2. Description of the Prior Art

Generally, a labeling machine of the portable type (which will be referred to as "hand labeler") or a portable label printing and tagging machine has a platen made of a hard material, such as a metal plate or hard plastic, so that a printing medium, e.g., a label, placed on the platen may be stamped or printed with the plural types which are arranged on type rings or bands.

The aforementioned types are usually made of an elastic material such as rubber. Consequently, even if the type surfaces of the respective series of the type rings or bands of a printing head are inclined or become irregular or uneven due to either error in the molding or assembling processes or to wear after use, any protruding types are compressed or crushed by the elasticity of the types themselves, when they are pressed onto the surface of the label upon the platen during the printing operation. This flattens the types as a whole into contact with the label surface so that the prints obtainable are averaged clean as a whole.

On the other hand, types made of a relatively hard material, such as plastic, have recently been used because they can be produced more easily and at a lower cost, while being more durable than types made of rubber. For types of plastic or metal, there will be no crushing of the protruding types during the printing operation, e.g., when the respective series of the types are inclined or become irregular, because the material of the types has reduced elasticity. As a result, since the type surfaces at recessed positioned either fail to contact the label surface or only slightly touch it, they fail to print type indicia or the indicia become thin, making it difficult to attain clear prints as a whole.

Thinned or incomplete prints are acceptable if they are to be read by human eyes, but they are less acceptable in a POS (Point-Of-Sales) system, which requires clear and highly accurate prints because the prints have to be read out by means of an optical reader.

SUMMARY OF THE INVENTION

It is therefore an object of the present invention to eliminate the drawbacks of the prior art.

Another object of the present invention is to provide a printing device which can provide averaged clear prints over the whole type printing surface.

A further object of the invention is to assure uniform imprints even if the type surfaces of the printing head are inclined or become irregular.

Yet another object of the invention is to realize the foregoing objects through improving the platen.

According to the present invention, a printing device is provided comprising a platen and a printing head having a plurality of types on the printing surface therof wherein the types are adapted to be brought into and out of contact with the platen, thereby to print a printing medium, such as a label, with a row of type characters. A type receiving plate forms a part of the platen. It is made of an elastic material. The plate is formed with a plurality of dividing grooves which are arranged parallel to each other for defining type receiving lands that register with respective type characters during the printing operation. The lands can be elastically deformed independently of one another, whereby the type receiving lands, the types contacting them and the labels can be exposed to a uniform printing pressure during the printing operation.

BRIEF DESCRIPTION OF THE DRAWINGS

Other objects and features of the present invention will become apparent from the following description taken in conjunction with the accompanying drawings showing embodiments of the present invention, in which.

DESCRIPTION OF THE PREFERRED EMBODIMENTS

Figure 1:
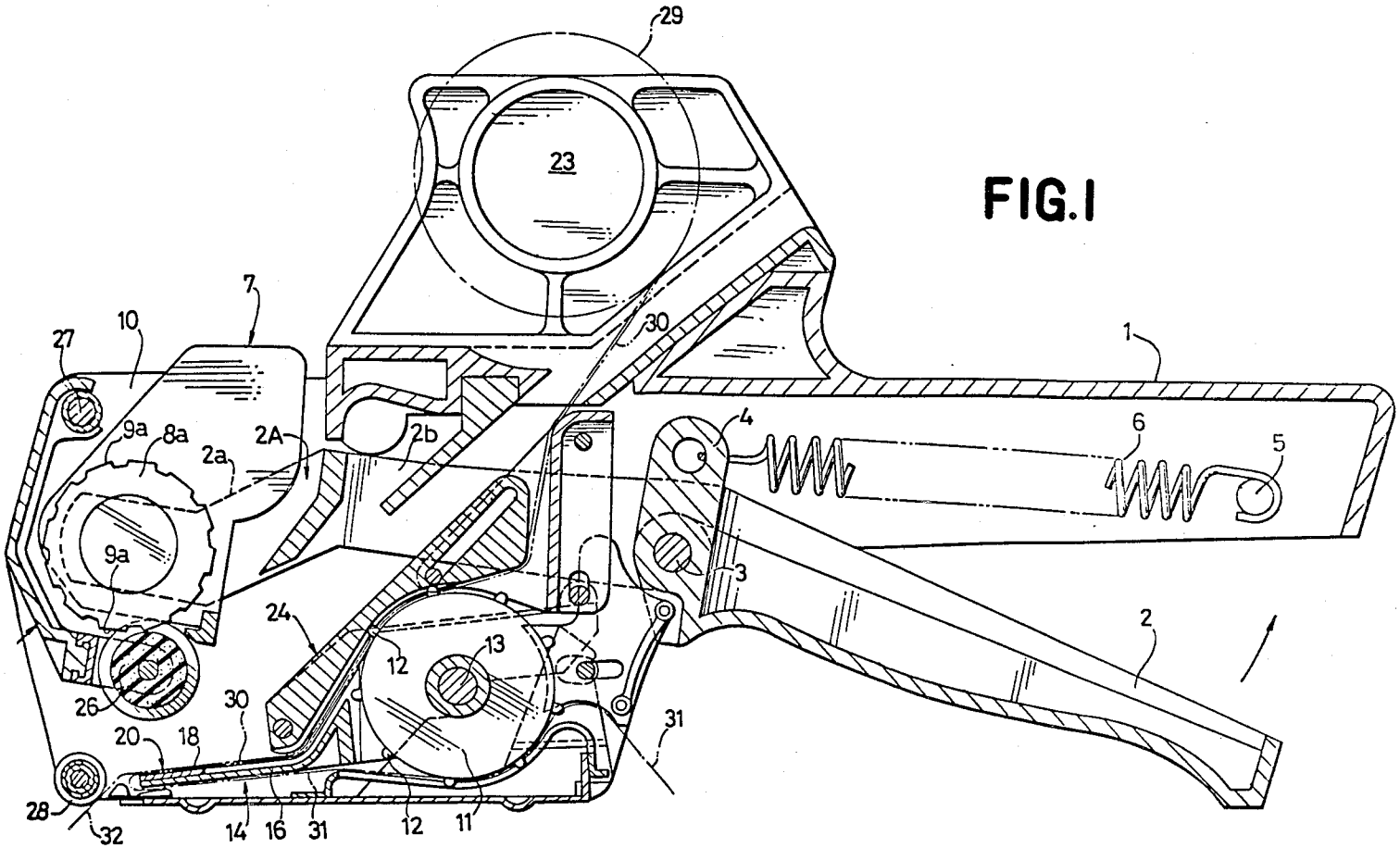
FIG. 1 is a cross-sectional side elevational view showing a hand labeler which is equipped with a printing device according to the present invention.

FIG. 1 shows an entire hand labeler which is equipped with a printing device according to the present invention. The hand labeler has its body extending backward (or rightward, as viewed in FIG. 1) to form an integral hand grip 1. Below the grip 1, a hand lever 2 is hingedly connected by means of a pivot pin 3 such that it can be squeezed between the main frames 10 of the labeler body toward and away from the grip 1.

The hand lever 2 has a front (left) portion which is integral with an actuating lever 2A which is comprised of a print portion **2*a* and a drive portion 2*b*. A printing head 7, is carried at the leading end of the print portion 2*a*. The printing head includes a plurality of type rings 8*a*, 8*b*, 8*c*, etc., each formed with respective sets of types 9*a*, 9*b*, 9*c***, etc., on their respective outer circumferences. The type rings are rotatably juxtaposed to one another. The type rings are made of hard plastic.

The hand lever 2 has a spring eye 4 at its upper front portion and the grip 1 has a spring pin 5 at its inner rear end. A return spring 5 is mounted under tension between the spring eye 4 and the spring pin 5 so that the hand lever 2 and the actuating lever 2A are biased clockwise at all times.

Below the drive portion **2*b* of the actuating lever 2A, there is a feed roller 11 which has feed pins 12 formed on its outer circumference at preset intervals. The feed roller 11 is rotatably mounted on a spindle 13 which is sandwiched between the main frames 10. The feed roller 11 is turned counter-clockwise by a drive mechanism (not shown), when the hand lever 2** is released, i.e., when the actuating lever 2A is returned upward, thereby to feed forward a continuous strip of labels 30 pitch by pitch.

There is a holder 23 for a rolled label strip 29 and a label guide member 24 for the fed off label strip 30. There is an ink applying member 25 which has one end that carries an inking roller 26 and has another end that is hingedly connected at 27 to the main frames 10. A label applying roller 28 is disposed at a lower front portion of the hand labeler.

Figure 2:
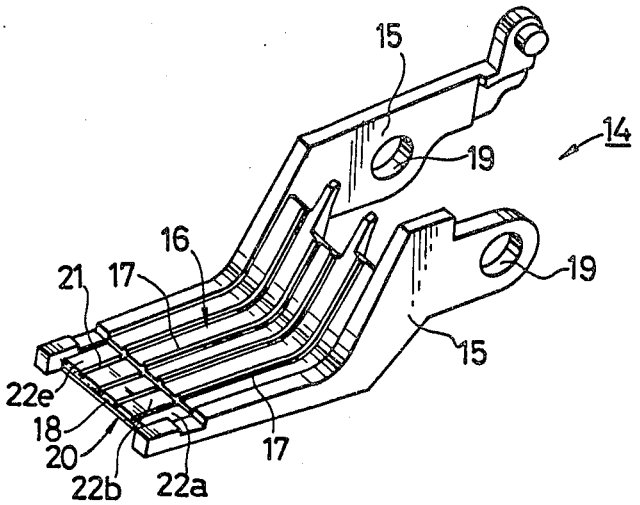
FIG. 2 is a perspective view showing a platen according to a first embodiment of the present invention.

In front (to the left) of the feed roller 11, there is a platen 14 which is used in the printing device according to the present invention. As shown in FIG. 2, the platen 14 is made of hard plastic or metal and is formed with side plates 15. These side plates 15 have holes 19 at their rear portions through which the aforementioned spindle 13 extends to support the feed roller 11 between the side plates 15.

Across the front portions of the side plates 15, on the other hand, there is an integral label guide plate 16, which is bent into a shape of the seat and back of a chair. The label guide plate 16 has a plurality of label feed ridges 17 formed on its upper side and which extend parallel to each other and in the forward direction of the label strip 30.

The front end portion of the label guide plate 16 is formed into a slight recess. In this recess, a type receiving plate 18 is mounted to form a printing portion 20. The type receiving plate 18 is fixed to the front end portion of the platen 14 by suitable means such as a duplicated adhesive tape or an adhesive. The type receiving plate 18 is made of an elastic material, such as rubber or soft plastic. The type receiving plate 18 may suitably be nitrilbutadiene rubber (NBR). the type receiving plate 18 also has a plurality of dividing grooves 21 which extend parallel to each other and in the forward direction of the label strip 30 in a manner to correspond to the boundaries of the respective types 9*a*, 9*b*, 9*c*, etc., of the printing head 7. The dividing grooves 21 define type receiving lands 22*a*, 22*b*, 22*c*, etc., which are registered with the type characters in the printing pressure during the printing operation.

Figure 3A:
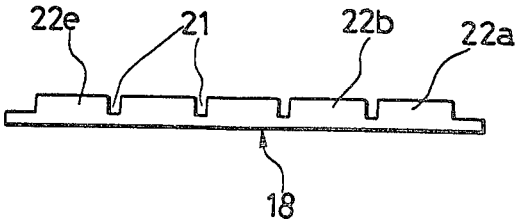
FIG. 3A is a front elevational view showing a type receiving plate for a platen according to the first embodiment.

According to the first embodiment shown in FIGS. 2 and 3, the dividing grooves 21 are formed in the upper side of the type receiving plate 18. Without limitation, the dividing grooves 21 have a suitable depth with a value of 0.5 to 0.7 units, have a suitable width with a value of about 0.5 units for the type receiving plate 18 having a thickness of 1 unit.

Figure 4:
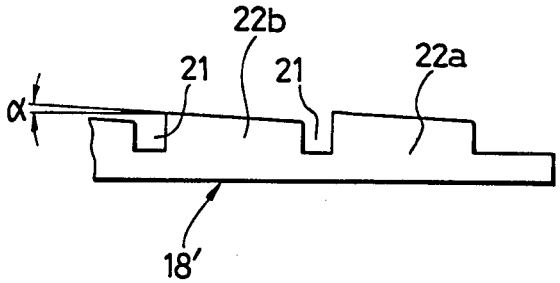
FIG. 4 is an enlarged front elevational view showing a portion of a type receiving plate according to a second embodiment of the present invention.

According to the second embodiment shown in FIG. 4, the type receiving lands 22*a*, 22*b*, 22*c*, etc., have their upper surfaces sloped in the same direction. These slopes are formed to offset the inclinations of the type characters of the printing head 7. More specifically, the respective type surfaces of the printing head 7 may be sloped, perhaps only slightly, mainly because of a molding error. This might cause the imprint on the label to become thin at one side. In view of this tendency, the sides of the respective surfaces of the type receiving lands 22*a*, 22*b*, 22*c*, etc., which might otherwise cause the imprint on a label to be thin, are sloped uphill. The suitable angle of inclination is about 2 to 3 degrees with respect to a horizontal plane.

Figure 5:
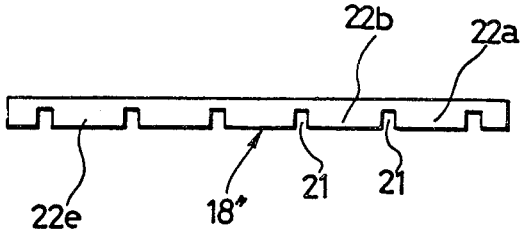
FIG. 5 is a front elevational view showing a type receiving plate according to a third embodiment of the present invention.

According to the third embodiment shown in FIG. 5, the dividing grooves 21 are formed on the lower side of a type receiving plate 18, rather than on the upper side.

The operation of the present invention is now described with reference to the various operative conditions of the hand labeler.

In the advancing of the label strip 30, which is fed off or unrolled from the rolled label strip 29, the label strip 30 is guided and forced by the lower side of the guide member 24 into contact with the outer circumference of the feed roller 11 until the perforations (not shown) in the label strip are brought into engagement with the feed pins 12 of the feed roller 11. Then the label strip 30 is fed forward along the upper side of the platen 14 until the forward end of the platen. There only the carrier paper 31 of the label strip is turned back in the space at the tip of the printing portion 20 of the platen so that the carrier paper is guided backward. The carrier paper 31 thus guided backward engages the feed pins 12 then at the lower circumference of the feed roller 11, and the carrier paper is then fed out of the hand labeler. In front of the printing portion 20 of the platen, labels 32 are peeled one by one from the carrier paper 31 and are fed to a position below the label applying roller 28.

When the hand lever 2 is gripped and moved up from the released condition of FIG. 1, the attached actuating lever 2A, is turned counter-clockwise about the pivot pin 3, which moves the printing head 7 down while the types 9*a*, 9*b*, 9*c*, etc., are supplied with ink by the inking roller 26. When the hand lever 2 is gripped to its full stroke, the types 9*a*, 9*b*, 9*c*, etc., hit the label strip 30 which is positioned on the type receiving plate 18 at the front end of the platen 14, thus printing the label strip.

Figure 3B:
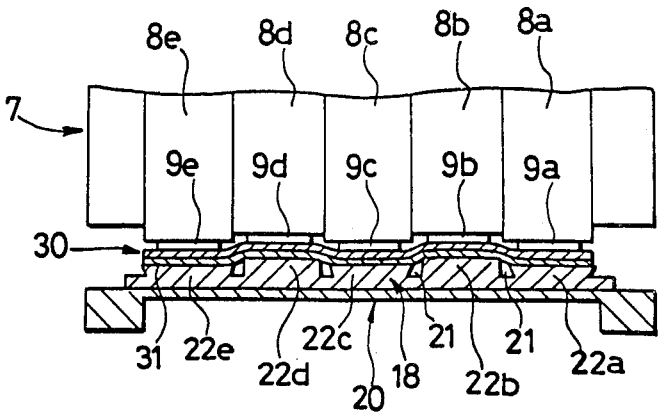
FIG. 3B is a sectional front elevational view showing the type receiving plate of FIG. 3A during the printing therewith.

In the printing condition, assume that the respective types 9*a*, 9*b*, 9*c*, etc., of the type rings 8*a*, 8*b*, 8*c*, etc., of the printing head 7, which are at the printing (or lowermost) positions, are so irregular, as shown in FIG. 3B, that the type surface comprised of all of these types is eneven as a whole. If the type receiving plate 18 were made, as customary, of a hard material such as a metal plate, the types in the recessed positions would either fail to contact the label surface or would merely slightly touch it so that their type indicia would not be printed or would only printed thin or pale. According to the present invention, however, the type receiving plate 18 is comprised of an elastic material and is formed with type receiving lands 22*a*, 22*b*, 22*c*, etc., which are defined by the dividing grooves 21 in a manner to correspond to the respective types 9*a*, 9*b*, 9*c*, etc. Thus, the respective type receiving lands 22*a*, 22*b*, 22*c*, etc., can be elastically deformed independently of one another, without difficulty. As a result, the type receiving lands 22*a*, 22*c* and 22*e* corresponding to the protruding types 9*a*, 9*c* and 9*e* are crushed by the pressure of the corresponding types 9*a*, 9*c* and 9*e*, whereas the type receiving lands 22*b* and 22*d* corresponding to the recessed types 9*b* and 9*d* are little deformed while maintaining their original shapes. Consequently, the continuous label strip 30 clamped between the types 9*a*, 9*b*, 9*c*, etc., and the type receiving plate 18 is deformed or curved along the upper surfaces of the aforementioned respective type receiving lands 22*a*, 22*b*, 22*c*, etc., as seen from FIG. 3B. As a result, the upper side of the label strip 30 and the surfaces of the types 9*a*, 9*b*, 9*c*, etc., are brought into substantially uniform contact to thereby attain a clear imprint of uniform density which is free of missing type indicia or thin and pale indicia.

The resultant effects can naturally be attained not only with hard printing types according to the present embodiment but also with conventional types which are made of an elastic material such as rubber.

The type receiving plate 18' according to the second embodiment shown in FIG. 4 is effective in case the type surfaces of the printing head are inclined during the molding process. More specifically, since the surfaces of the respective type receiving lands 22*a*, 22*b*, 22*c*, etc., are sloped in one direction to offset the inclinations of the type characters of the printing head, they can allow the continuous label strip 30 on the lands to be uniformly hit by the moving type characters, thereby to attain a clear imprint which is free from being blurred are dimmed.

In the type receiving plate 18" according to the third embodiment shown in FIG. 5, the dividing grooves 21 are formed in the lower side of the receiving plate 18". The respective type receiving lands 22*a*, 22*b*, 22*c*, etc., corresponding in their position to the types of the printing head can also be easily defomed in an elastic manner by the printing pressure similarly to the foregoing first and second embodiments.

In all of the embodiments, if the hand lever 2 is released after the printing operation thus far described, it is returned clockwise together with the actuating lever 2A by the biasing force of the return spring 6. As a result, the printing head 7 is carried up, and the drive mechanism (not shown) operates to turn the feed roller 11 over a preset angle so that the label strip 30 is advanced one pitch by the feed pins 12 of the feed roller 11. Meanwhile, since the carrier paper 31 is pulled back by the feed pins 12, the printed label 32 is peeled off the carrier paper 31 and is fed to a position below the label applying roller 28 until the label is applied to a commodity or the like.

Since the label guide plate 16 has its upper side formed with the feed ridges 17, the lower side of the continuous label strip 30 at the carrier paper 31 is fed forward, while contacting with the upper sides of the feed ridges 17 only, with a resultant reduction in the frictional resistance. Thus, the label strip 30 can be fed remarkably smoothly.

As described hereinbefore, according to the present invention, the type receiving plate of the platen is made of an elastic material and is formed with dividing grooves which are arranged to define such type receiving lands as are registered with respective type characters and which can be elastically deformed independently of one another. As a result, even if the respective type surfaces of the printing head are inclined or become irregular, the aforementioned type receiving lands can be easily deformed in an elastic manner independently of one another. As a result, the types can be brought as a whole into uniform contact with the label surface with the resultant effect that the whole surface of the label can be printed so clear and with uniform density as to be free from having any of its type indicia missing or thin or pale. Furthermore, the impact shock during the printing operation is absorbed so as to prevent the printing head and the platen from being damaged.

Although the present invention has been described in connection with the preferred embodiments thereof, many variations and modifications will now become apparent to those skilled in the art. It is preferred, therefore, that the present invention be limited not by the specific disclosure herein, but only by the appended claims.

What is claimed is:

1. A printing device for printing a plurality of types on an imprintable medium, comprising:

a printing head having a plurality of types, the plurality of types comprising a plurality of rotatable means with each rotatable means carrying a respective series of types and each rotatable means being rotatable to move a respective type of the respective series to a printing position; at the printing position, the types of each of the rotatable means then at the printing position together define a printing surface on which the types are positioned for engaging an imprintable medium;

a platen for supporting an imprintable medium and including a type receiving plate positioned for being contacted by the types of the printing surface;

means mounting all of the rotatable means for movement together as one unit, and means for moving all of the rotatable means and the types thereof then on the printing surface toward and simultaneously against the type receiving plate for imprinting an imprintable medium on the plate;

the type receiving plate being comprised of a plurality of independent lands, corresponding in position to respective ones of the types on the printing surface; each type is to be contacted and the top surface together being generally planar; each of the lands being independently elastically deformable for establishing a generally uniform printing pressure for each of the types against a respective land when the types simultaneous contact the lands; said plate having a general orientation and the top surfaces of said lands being sloped in orientation with respect to said plate for matching the slopes of the imprintable surfaces of said types.

2. The printing device of claim 1, wherein the plate comprises a single unit and the lands thereon are defined by and between dividing grooves formed in the plate, which cause the lands each to protrude from the surface of the plate toward the top surfaces.

3. The printing device of claim 2, wherein the grooves are parallel to each other.

4. The printing device of claim 3, further comprising means for feeding an imprintable medium over the platen;

the printing head being arranged such that the types are arrayed across the feed direction of the imprintable medium; the grooves being oriented parallel to the feed direction of the imprintable medium.

5. The printing device of claim 2, wherein the plate has a first side with the top surfaces thereon, which is opposable to the types, and the plate has an opposite, second side away from the types; the grooves being defined in the first side of the plate.

6. The printing device of claim 2, wherein the plate has a first side with the top surfaces thereon, which is opposable to the types, and the plate has an opposite, second side away from the types; the grooves being defined in the second side of the plate.

7. The printing device of claim 1, further comprising means for feeding an imprintable medium over the platen;

the platen having a support surface thereon upstream in the feeding path of the imprintable medium from the plate, and the support surface having ridges thereon along which the imprintable medium is carried as it is fed.

8. The printing device of claim 1, further comprising means for feeding an imprintable medium over the platen;

the printing head being arranged such that the types are arrayed across the feed direction of the imprintable medium.

* * * * *